US006059039A

United States Patent [19]

Bednar et al.

[11] Patent Number: 6,059,039

[45] Date of Patent: May 9, 2000

[54] EXTENDABLE SEMI-CLUSTERED SUBSEA DEVELOPMENT SYSTEM

[75] Inventors: John M. Bednar, Kingwood, Tex.; Mark A. Stair, Metairie, La.

[73] Assignee: ExxonMobil Upstream Research Company, Houston, Tex.

[21] Appl. No.: 08/968,637

[22] Filed: Nov. 12, 1997

[51] Int. Cl.[7] ..... E21B 43/017

[52] U.S. Cl. ..... 166/344; 166/366; 166/368; 405/224

[58] Field of Search ..... 166/344, 360, 166/366, 368; 405/204, 224, 224.2

[56] References Cited

U.S. PATENT DOCUMENTS

| | | | |
|---|---|---|---|
| 4,052,703 | 10/1977 | Collins, Sr. et al. . | |
| 4,120,362 | 10/1978 | Chateau et al. | 166/339 |
| 4,228,857 | 10/1980 | Nobileau | 166/341 |
| 4,378,848 | 4/1983 | Milberger | 166/362 |
| 4,437,521 | 3/1984 | Richardson et al. | 166/341 |
| 4,442,900 | 4/1984 | Padilla et al. | 166/342 |
| 4,452,312 | 6/1984 | Roblin | 166/339 |
| 4,625,805 | 12/1986 | Ladecky | 166/341 |
| 4,705,114 | 11/1987 | Schroeder et al. | 166/357 |
| 4,784,527 | 11/1988 | Hunter et al. | 166/366 X |
| 4,848,474 | 7/1989 | Parizot et al. | 166/366 |
| 4,848,475 | 7/1989 | Dean et al. | 166/368 X |
| 4,899,822 | 2/1990 | Daeschler et al. | 166/339 |
| 5,025,865 | 6/1991 | Caldwell et al. | 166/366 |
| 5,040,607 | 8/1991 | Cordeiro et al. | 166/366 |
| 5,191,167 | 3/1993 | Da Silva et al. | 405/195.1 |
| 5,255,744 | 10/1993 | Silva | 166/347 |

*Primary Examiner*—George Suchfield

[57] ABSTRACT

A subsea production system that facilitates the cost effective development of offshore hydrocarbon reserves. The system includes a template base, a wellhead assembly, a saddle manifold, flowlines, a subsea tree assembly, and a control center. The system facilitates phased development by allowing control over timing for the installation of system components and by providing extendibility to additional wells developed after installation of the system.

64 Claims, 7 Drawing Sheets

EXTENDABLE SEMI-CLUSTERED SUBSEA DEVELOPMENT SYSTEM

SPECIFICATION

1. Field of the Invention

This invention relates to a subsea petroleum production system and, more particularly, to a semi-clustered configuration of subsea production system components which allows phased development and integration of wells.

2. Description of the Prior Art

In the 1970's, the petroleum industry began to produce hydrocarbons from offshore subsea wells. Over the past three decades, many different configurations of subsea production system components have been generated to help develop these offshore hydrocarbon reserves. Depending upon the number of wells required by a given production plan, the system configurations range from a single satellite subsea well producing to a host platform, to large multi-well subsea template/manifold systems producing to a host platform or a large floating production unit.

In subsea template/manifold systems, wells are drilled from one single structure, and hydrocarbons are collected in a single manifold attached to the template for delivery to a production platform or other surface production unit. Various forms of templates have been used to integrate production of various subsea producing wells into a single area and to more easily collect the production in a single manifold. The main advantage of the template/manifold systems is the reduction in the number of remote interface connections between the wells and the manifold.

More recently, subsea clustered configurations have come into use, featuring a central manifold surrounded by a number of subsea satellite wells. See, for example, U.S. Pat. Nos. 4,848,475 and 5,025,865.

Where marginal fields are located in deep water, operators will often choose to initially place only a few subsea wells in specific locations to evaluate producability before installing a high cost production facility. Further, operators may wish to incrementally add wells such that the reservoir and production data from each successive well may be used to better assess the risk of subsequent development efforts. Accordingly, a method of extending subsea flowlines from an initial template to later drilled wells at a second template site would be desirable if it could minimize the investment required in the initial installation to accommodate such future expansion.

SUMMARY OD THE INVENTION

The extendable semi-clustered subsea development system is a novel configuration of subsea production system component hardware that facilitates cost effective development of offshore hydrocarbon reserves. The system facilitates phased development by allowing control over timing for the installation of system components and by providing extendibility to additional wells developed after installation of the system.

The system has a template base which provides foundation structure for the entire system. The template base typically has at least two well receptacles through which hydrocarbon wells can be drilled. In the case of an existing exploratory well, the template base can be mounted over an existing well head assembly. Additional well receptacles allow wells to be drilled after installation of the system.

A saddle manifold mounts on to the template base, sitting like a saddle over the template base structure. This saddle manifold contains mating connections for subsea tree assembly connectors, manifold valves for isolation, connection assemblies to connect with flowlines from the surface, and production headers. The production headers have a means of connecting a flowline extension from the first well site to a second site.

A subsea tree assembly mounts onto the well head assembly, located in the template base. The tree is connected by piping to the saddle manifold. The valves of the subsea tree are controlled by an expandable control center which is located apart from the template or the manifold. Jumper umbilicals connect the tree assemblies to the control center.

BRIEF DESCRIPTION OF THE DRAWINGS

A better understanding of the invention can be obtained when the detailed description set forth below is reviewed in conjunction with the accompanying drawings, in which.

DETAILED DESCRIPTION OF PREFERRED EMBODIMENTS

Figure 1:
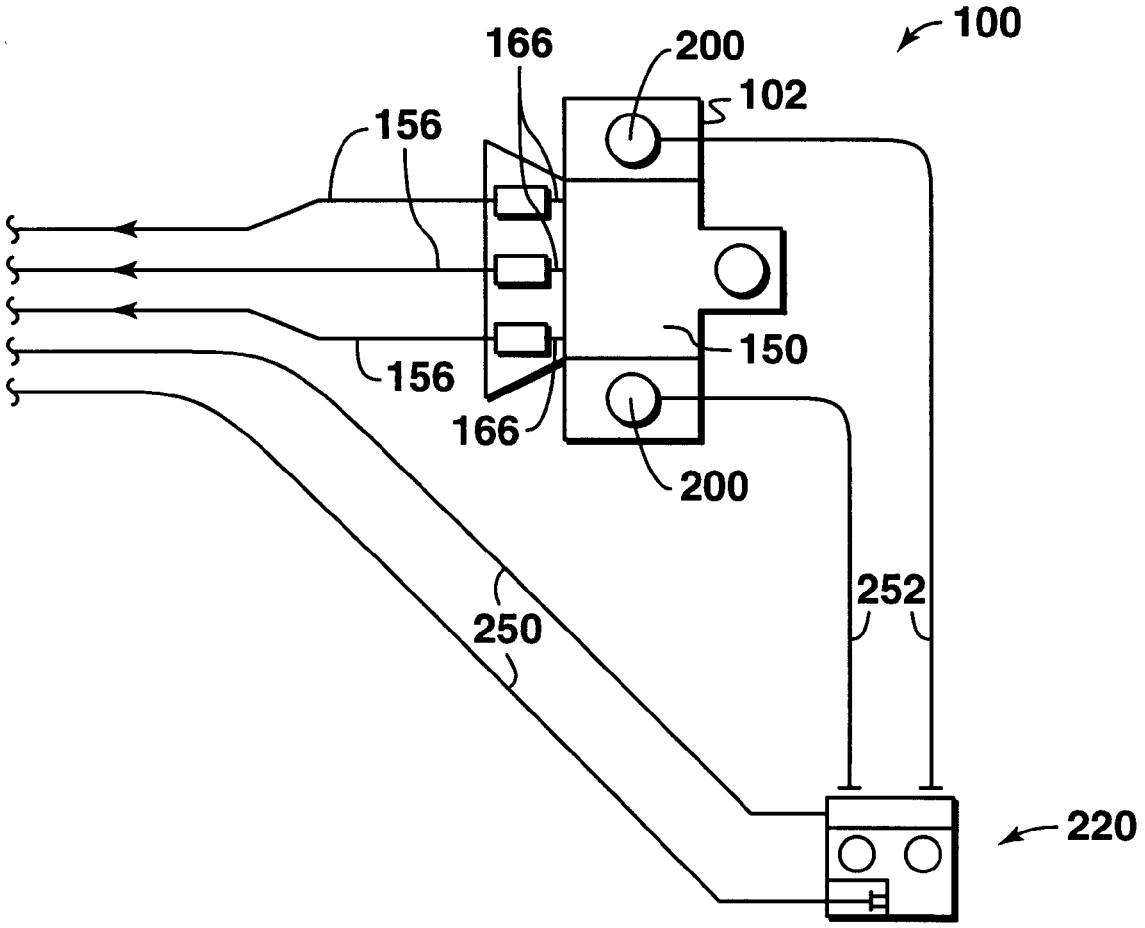
FIG. 1 is a schematic diagram of a two well extendable semi-clustered subsea development system according to the present invention.

As shown in FIG. 1, the present invention is an extendable semi-clustered subsea development system 100 that facilitates cost effective development of offshore hydrocarbon reserves. While FIG. 1 shows a complete initial installation of an embodiment of the extendable semi-clustered subsea development system 100, it will be appreciated that among the advantages of system 100 are the ability to install components of system 100 in phases and to extend the system to additional development wells. System 100 can be utilized with any type of host facility that can support production and accommodate surface components of a control system.

In the embodiment of system 100 shown, flowlines 156 extend from a surface facility and connect to production headers 166 on a saddle manifold 150. Hydrocarbons are directed from wellheads 120 (see FIG. 3) through subsea tree assemblies 200 to production headers 166 of saddle manifold 150 and into flowlines 156 for return to the surface facility. Saddle manifold 150 and subsea tree assemblies 200 sit atop a supporting template base 102. A control center 220 connected to the surface facility by main umbilical lines 250 and to subsea tree assemblies 200 by jumper umbilicals 252 allows control of hydrocarbon production from the surface facility.

Figure 2:
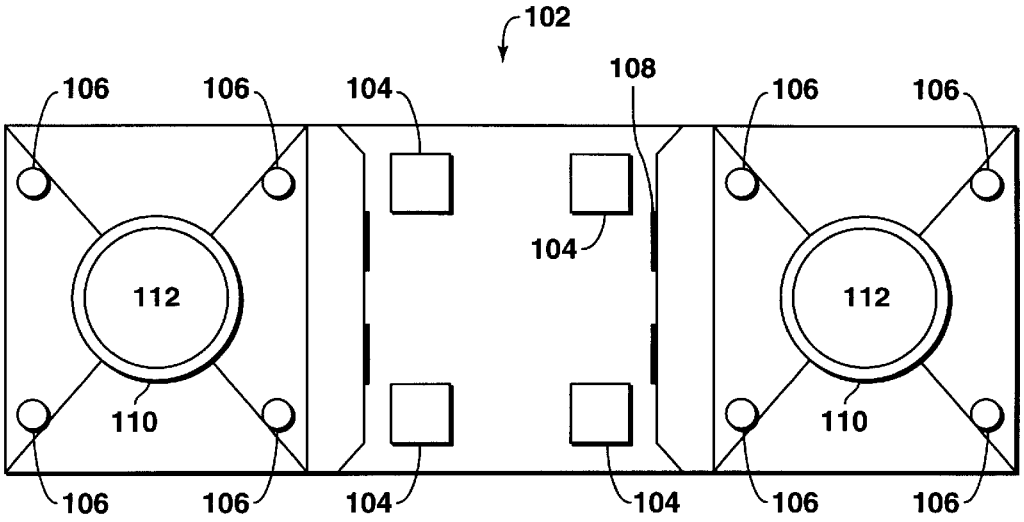
FIG. 2 is a top view of a preferred embodiment of the template base according to the present invention.

As shown in FIG. 2, template base 102 is the foundation support for the system. Typically, template base 102 has at least two well receptacles 112 (to accommodate two wells as shown) or it may have four wells receptacles. As will be appreciated, template base 102 can be designed for additional wells; however, two to four wells are more characteristic of phased or marginal development scenarios for which the present invention is most applicable. Template base 102 may have more than four well receptacles if desired.

Each well receptacle 112 has a latch ring 110 for connecting to a wellhead. Guide posts 106 are positioned adjacent to each well receptacles 112 to assist in later setting of a subsea tree assembly onto the wellhead. Pads 104 and vertical rails 108 are installed on template base 102 to guide a saddle manifold 150 into position.

Figure 3:
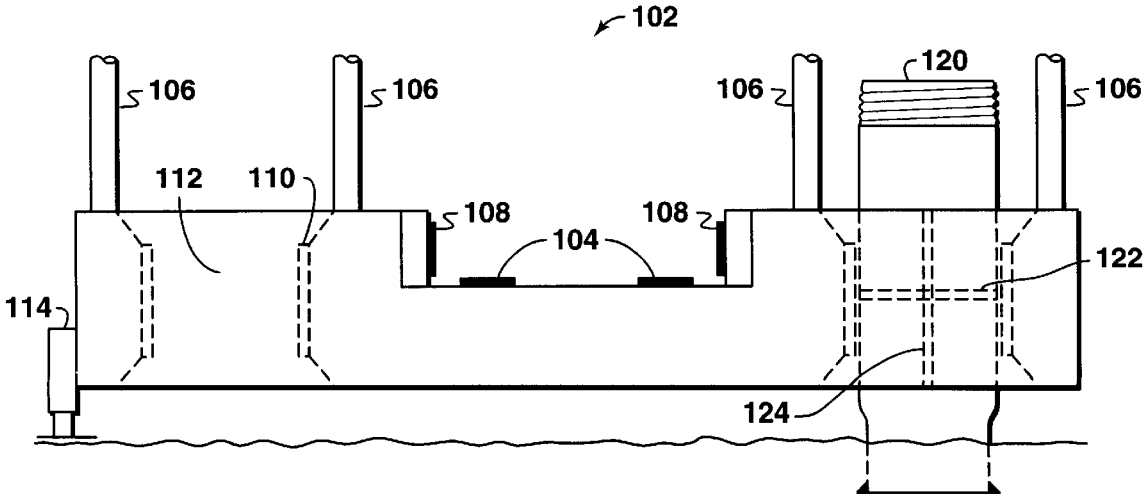
FIG. 3 is a side view of the template base of present invention as shown in FIG. 2.

To determine the economic producability of a prospective site, an appraisal well is often drilled. As shown in FIG. 3, once a decision to develop the site further is made, template base 102 can be positioned over wellhead 120 of the appraisal well. To facilitate installation of template base 102, wellhead 120 can be equipped with an outer groove 122 or other locating/latch mechanism that assists in positioning template base 102 existing wellhead 120. Optionally, a vertical groove 124 may be placed on the outer surface of wellhead 120 to facilitate orientation of template 102 relative to wellhead 120. The template base 102 can be equipped with an adjustable support foot 114 to help support and level template base 102.

Alternatively, template base 102 can be installed first and wells can be drilled through it. Using this approach, the incremental cost to the appraisal well of initially installing template base 102 is small because template base 102 is a relatively simple steel structure. Once template base 102 is in place, additional wells can be drilled at any time.

Figure 4:
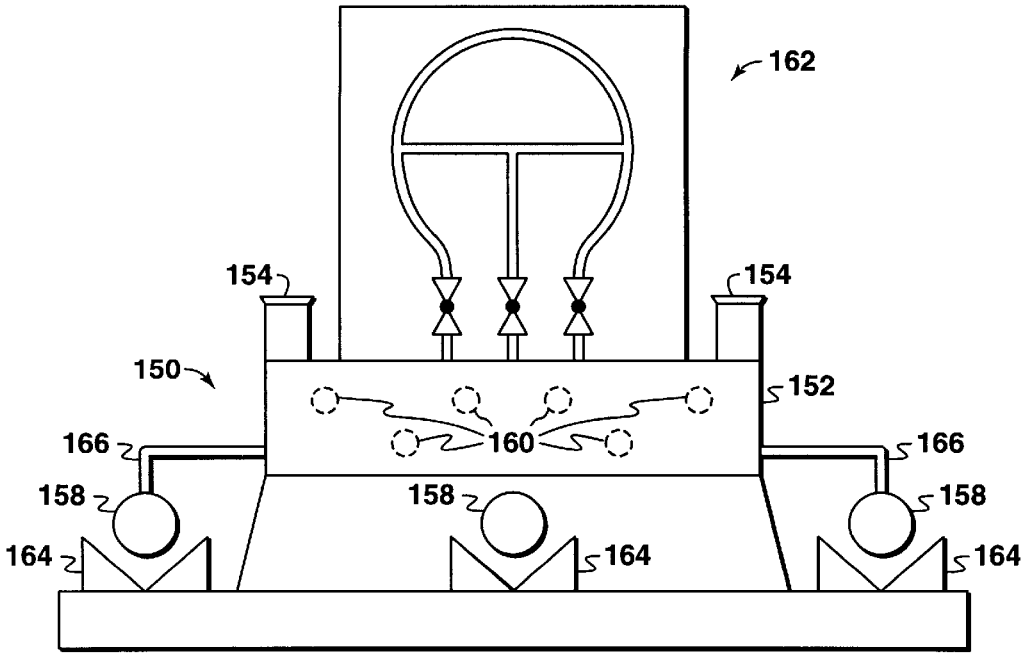
FIG. 4 is a frontal elevation view of the preferred embodiment of a saddle manifold having a pigging valve assembly.
Figure 5:
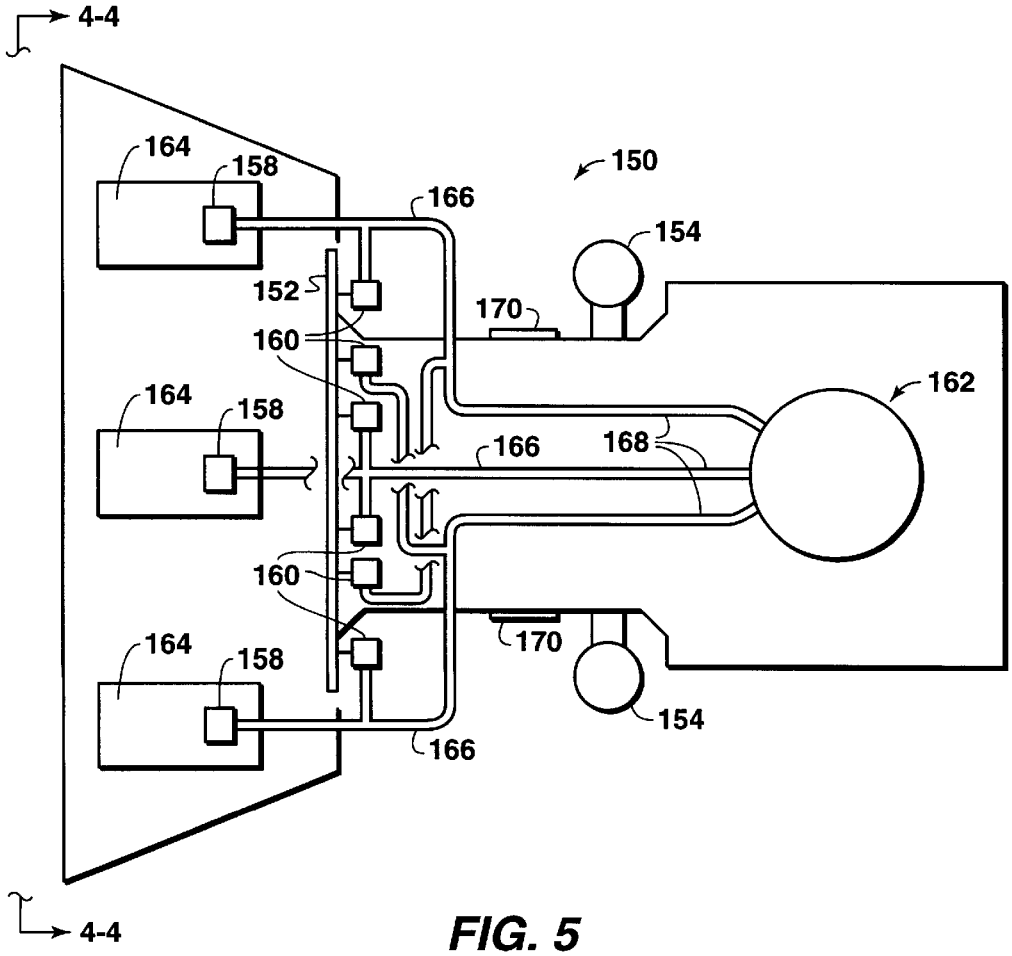
FIG. 5 is a top view of the saddle manifold of the present invention as shown in FIG. 4.

As shown in FIGS. 4 and 5, saddle manifold 150 is typically installed once a decision is made to produce the prospect well. Saddle manifold 150 is lowered onto template base 102. Pads 104 and vertical rails 108 guide saddle manifold 150 into position and assure proper vertical and horizontal registration for subsequent connections. Alternatively, guide post receptacles 154 on saddle manifold 150 may be included to guide saddle manifold 150 onto posts (not shown) on template base 102. While the weight of the saddle manifold 150 may be sufficient to keep it in place, it may optionally be equipped with a latch 170 for securing the saddle manifold to template base 102.

Typically, at least one well is in place before installing saddle manifold 150. The fabrication and installation of saddle manifold 150 is flexible and may be deferred until all well data is available. Similarly, installation may be scheduled to take optimum advantage of any cost incentive associated with availability of installation vessels. It is also possible to install saddle manifold 150 prior to the drilling of any wells if template base 102, without a wellhead 120, can provide sufficient foundational support. Template base 102 can be equipped with adjustable supports 114 to provide such sufficient foundational support.

Production headers 166, manifold valves 160, and flowline connection assemblies 158 are typically part of saddle manifold 150. Manifold valves 160 isolate production headers 166 prior to installation of tree assemblies and are typically mounted on a structural plate 152 to facilitate access by remotely operated vehicles. Flowline connection assemblies 158 connect subsea flowlines to production headers 166. Additionally, saddle manifold 150 can be equipped with an integral guidance structure 164 to facilitate installation and connection operations for the flowlines.

The saddle manifold 150 typically includes one to three production headers 166 that direct hydrocarbon production from a subsea tree assembly to subsea flowlines for delivery to a surface facility. Saddle manifold 150 may have four or more production headers. Production headers 166 are also equipped with a means for connecting flowline extensions that extend to a second site.

Terminal ends 168 of production headers 166 can be equipped with a retrievable pigging valve assembly 162 to facilitate flowline maintenance and provide means for connecting flowline extensions. Pigging valve assembly 162 also provides a means of directing fluid flow from one production header to a second production header when a pigging device is used to clean the flowlines and production headers. Assembly 162 can be removed and modified to provide a connection for flowline extensions. Assembly 162 is discussed in more detail in copending patent application Ser. No. 08/969,131, filed Nov. 12, 1997, and entitled "Flowline Extendable Pigging Valve Assembly," which application is hereby incorporated by reference and made a part of this patent application. Alternatively, valves equipped with a second set of flowline connection assemblies can be added to end 168 of production headers 166 to provide means of connecting flowline extensions.

Figure 6:
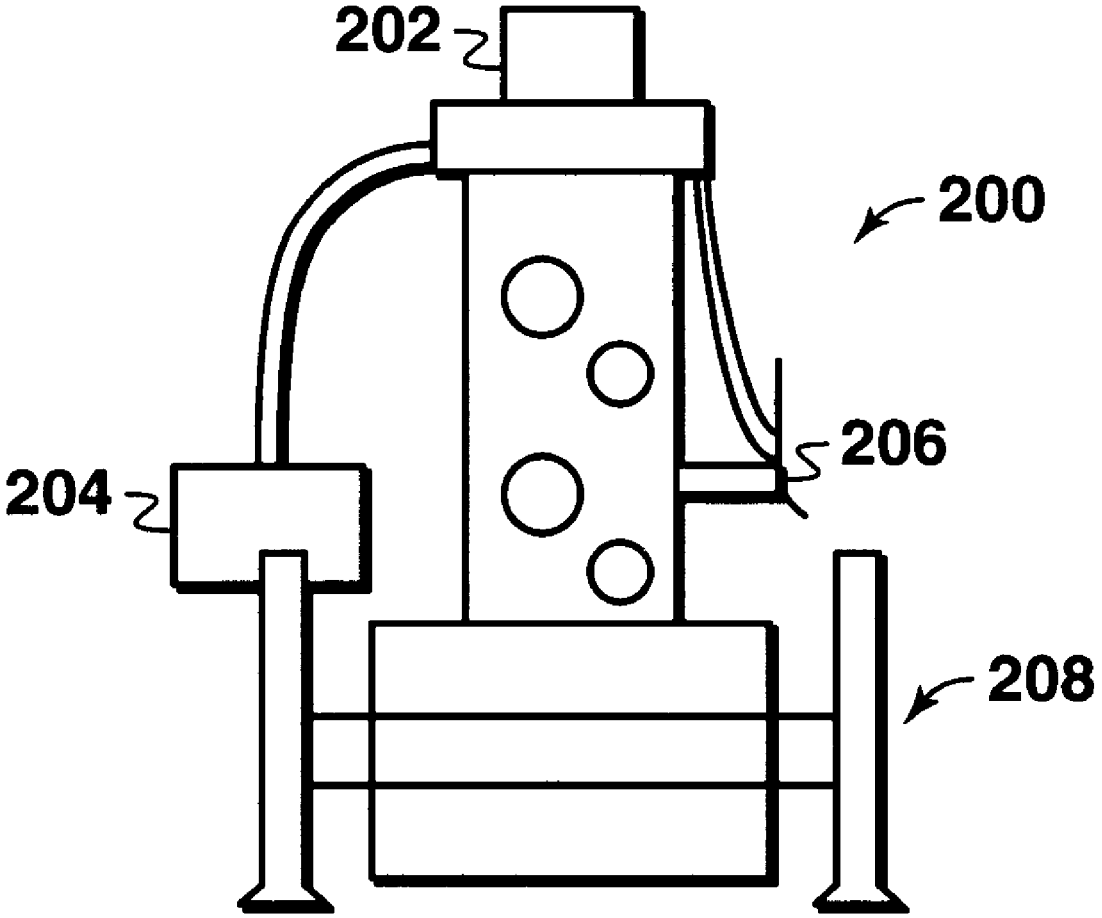
FIG. 6 is a side view of a subsea tree assembly.

As shown in FIG. 6, a subsea tree assembly 200 includes a tree cap 202, a tree-to-manifold flow connection port 204, and a tree guidance frame 208. While the invention can accommodate most commercially available subsea tree assemblies, those assembly designs that are less restrictive in dimensional constraint on tree-to-manifold connection 204 are preferred. Outboard connection assembly 206 of tree assembly 200 accommodates hydraulic connections for control of individual tree functions. Electrical connections also may be integrated into tree assembly 200 if tree assembly pressure or temperature or downhole monitoring is desired.

Figure 7:
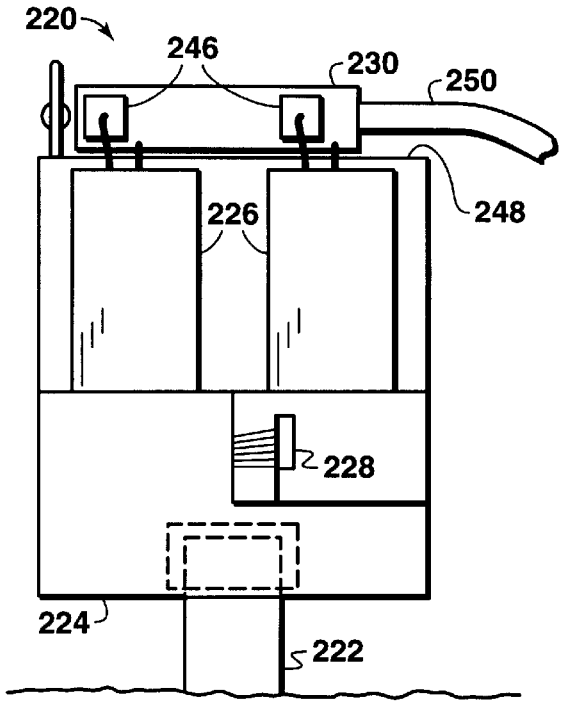
FIG. 7 is a frontal elevation view of the preferred embodiment of the system control center.
Figure 8:
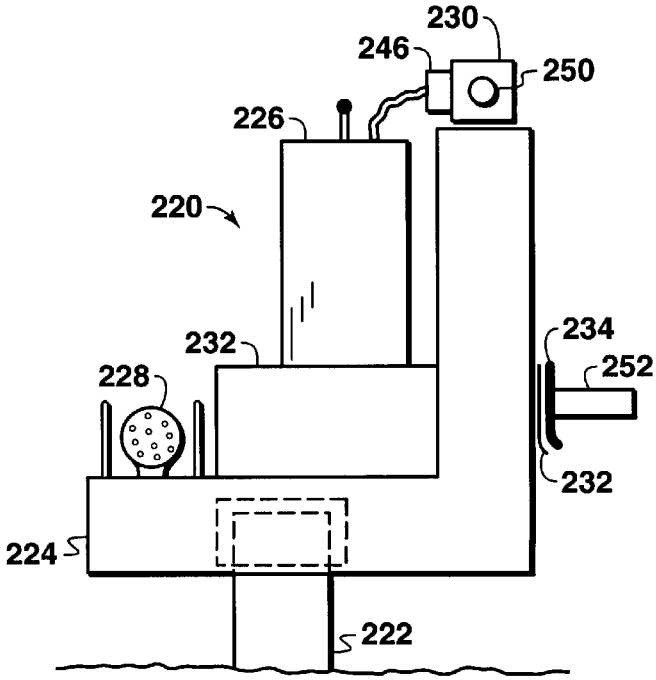
FIG. 8 is a side elevation of the system control center shown in FIG. 7.

Control of one or more subsea tree assemblies 200 may be done by direct hydraulic control using a hydraulic umbilical line for each individual well tied directly to subsea tree control connection assembly 206 for each individual well. In some cases, piloted-hydraulic or electro-hydraulic controls may be tied directly to subsea tree assemblies 200. As shown in FIGS. 7 and 8, it is preferred that when using the present invention with piloted-hydraulic and electro-hydraulic controls, to utilize a control center 220 that is separate and apart from template base 102 and saddle manifold 150 to facilitate phased development and integration of additional wells.

Each control center 220 typically includes a support pile 222 driven into the sea floor at a specified location away from template base 102. Alternatively, a section of casing may be drilled or jetted at the location to provide equivalent support. A control distribution skid 224 is then lowered onto support pile 222 and may be latched in place. Also, grooves or lugs (not shown) may be used in support pile 222 and skid 224 to facilitate orientation. Preferably, control skid 224 is sized to allow installation through a moon pool of a drilling rig.

Components of control skid 224 can be configured in many different ways to accommodate the packaging constraints of a commercial control system supplier. In the embodiment shown in FIGS. 7 and 8, control skid 224 provides mating connection 228 for hydraulic umbilical termination and also provides landing base 248 as support for electrical umbilical termination assembly 230. As will be appreciated by those skilled in the art, electrical umbilical termination assembly 230 includes junction plates 246 with either inductive or conductive connectors to control pods 226 and other integral components. A base 232 for control pods 226 is also included which is integral with the skid 224. Typically, all required control pods 226 for a development site are placed on a single skid.

As shown in FIG. 8, jumper umbilicals 252 are connected to control center 220 at jumper umbilical connectors 232 (Only one set of jumper umbilicals and jumper umbilical connectors shown). Jumper umbilicals are typically bundles of hoses or tubes that control individual functions of tree assembly 200. Electrical circuits can be included in the jumper umbilicals if tree assembly pressure or temperature or downhole monitoring is desired. Preferably, connection assembly 234 of jumper umbilical 252 is capable of installation by a remote operated vehicle. Using jumper umbilicals provides an ability to stage individual wells such that jumper umbilicals can be moved from one well to a subsequent well after the first well is depleted, thus saving the cost of additional control pods 226.

The location of control center 220 is flexible and allows for optimization of connections for jumper umbilicals 252. In selecting a location for control center 220, however, consideration should be given to the positioning and lay direction of main umbilicals 250 relative to the mooring pattern for the drill ship. It may be desirable to lay main umbilicals 250 toward the template 102 such that they can curve into a flow path beneath the catenaries of a ship's mooring lines. (see FIG. 1).

Figure 9:
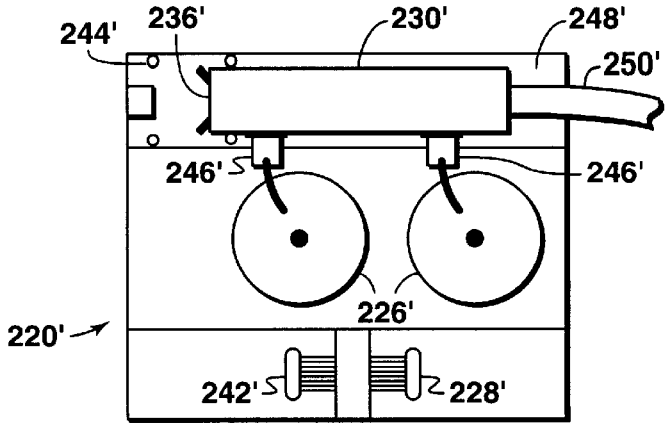
FIG. 9 is a top view of an alternative embodiment of the system control center.

An alternative embodiment of the present invention is shown in FIG. 9 wherein the same reference numerals are used for similar elements as in the preferred embodiment but with a prime designation. Control center 220' shown in FIG. 9 includes an extendable electrical umbilical termination assembly 230' to facilitate extending an electrical umbilical from an initial development site to a subsequent site.

This embodiment of control center 220' includes junction plates 246' connecting to control pods 226' and also an additional junction plate 236' to accommodate connection of an electrical umbilical extension (not shown). As will be appreciated, couplers should be sized to handle power requirements for transmission through an umbilical extension. Additionally, a cover (not shown) can be provided to protect couplers and minimize power losses prior to the actual utilization of the umbilical extension. Further, this embodiment of control center 220' includes a landing base 248' equipped with structural supports to help support the electrical umbilical extension. A second set of guideposts 244' are installed to facilitate installation of the electrical umbilical extension.

Additionally, control center 220' includes mating connection 228' for hydraulic umbilical termination. By adding a second hydraulic umbilical mating connection 242' to skid 224', hydraulic umbilicals can be extended.

Figure 10:
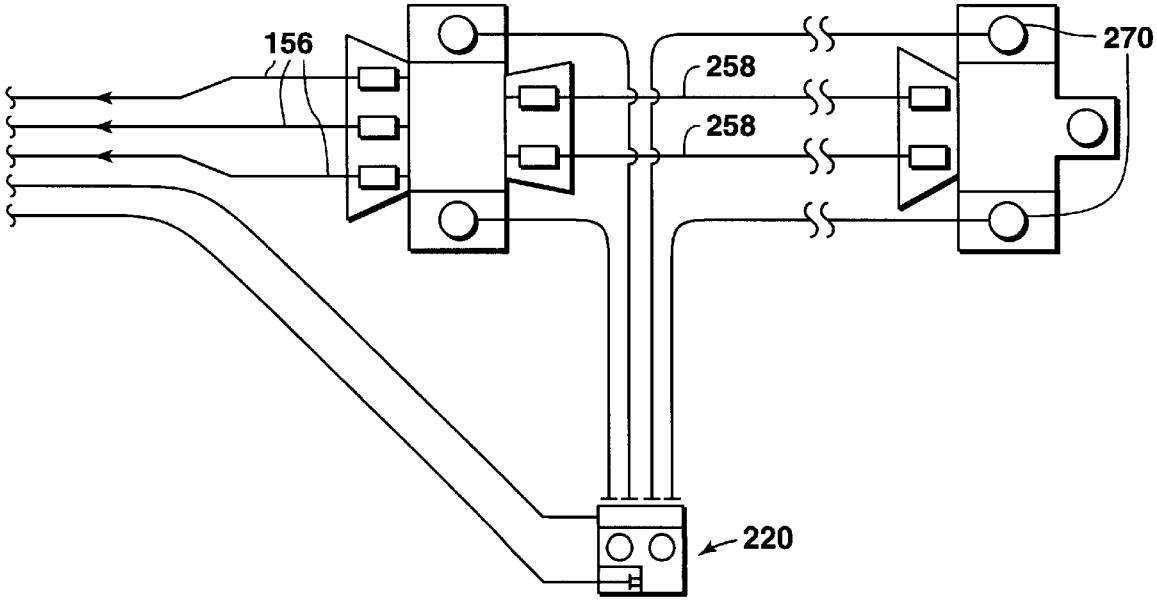
FIG. 10 is a schematic diagram of the two well extendable semi-clustered subsea development system of FIG. 1 expanded to encompass an additional two well system.

Numerous uses and embodiments of extendable semi-clustered subsea development system 100 may be utilized. FIG. 10 shows system 100 of FIG. 1 after extension to service two additional wells 270. In this embodiment, two flowline segments 258 are used to extend two flowlines 156. All wells are controlled from a centrally located control center 220.

Figure 11:
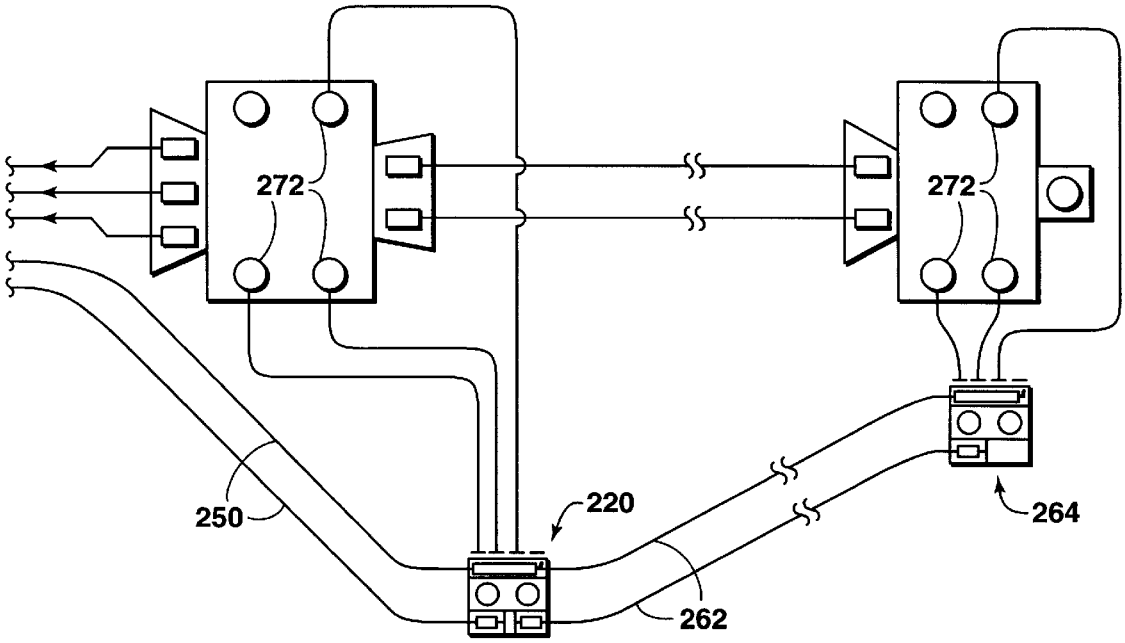
FIG. 11 is a schematic diagram of an embodiment of a four well extendable semi-clustered subsea development system according to the present invention expanded to an eight well system.

Similarly, FIG. 11 shows an eight well development, with three wells 272 in place in each template/manifold. In this embodiment, umbilicals 250 extend from control center 220 with umbilical segments 262 to service a second control center 264, an optional approach which potentially lowers the project cost for jumper umbilicals. A further adaptation of the invention can incorporate fully clustered satellite wells.

As can be appreciated, the extendable semi-clustered subsea development system is a novel configuration of subsea production system component hardware that facilitates the cost effective development of offshore hydrocarbon reserves. The system facilitates control of capital expenditures for the installation of required system components and provides simple extendibility of the system in the event additional wells are required, either in close proximity to the initial installation or some distance apart.

The invention helps the operator manage development risks by providing a means to integrate exploration and appraisal wells thereby offering greater flexibility and timing for the installation of various components, and by providing a means for extending the system to accommodate additional wells. The present invention's components are also recoverable so that as wells are depleted the trees may be retrieved for reuse and the corresponding jumper umbilicals relocated to the next well or recovered for use elsewhere. In view of the high cost and risk associated with developments in deep water, it very helpful if the operator has the ability to manage capital expenditures required for the development relative to the uncertainties of the reservoir as well as market fluctuations.

It will be appreciated by one skilled in the art based on this disclosure that variations and modifications may be made to the embodiments of the invention without departing from the spirit or scope of the invention as set forth in the accompanying claims. It is intended that all such variations and modifications fall within the scope of the present invention as claimed.

What is claimed is:

1. A subsea template/manifold system for phased development of subsea well at a first site capable of being expanded to develop one or more additional wells at a second site, the system comprising:

at least one flowline extending downwardly from a surface facility to the first well site for directing flow away from the first well site;

at least one subsea wellhead;

a template base having one or more receptacles capable of receiving a wellhead;

a subsea tree assembly mounted on said wellhead and having a tree-to-manifold connection port;

a saddle manifold mounted on said template base and having at least one production header for directing flow from said tree assembly to said flowline, said manifold also having a valve for isolating the production header from said tree assembly;

said production header having (a) a first end in fluid communication with said flowline, (b) a connection providing fluid communication with said tree-to-manifold connection port, and (c) a second end; said second end being extendable to the second site without preventing a well receptacle from being able to accommodate a well; and a remote control center for controlling operation of said tree assembly.

2. The system of claim 1 wherein said template base comprises less than five well receptacles.

3. The system of claim 1 wherein said template base further comprises a latch ring.

4. The system of claim 1 wherein said template base further comprises at least one pad and at least one rail for aligning said saddle manifold on said template base.

5. The system of claim 1 wherein said saddle manifold comprises less than four production headers.

6. The system of claim 1 where said second end comprises an extendable pigging valve assembly.

7. The system of claim 1 wherein said control center comprises a subsea control center having an umbilical termination assembly and control pods.

8. The system of claim 1 wherein said template base comprises at least four well receptacles.

9. The system of claim 1 wherein said remote control center comprises a surface control center having a direct umbilical line connection to said subsea tree assembly.

10. The system of claim 1 wherein said saddle manifold comprises at least four production headers.

11. The system of claim 1 wherein said wellhead further comprises a vertical groove for facilitating rotational positioning of said template base.

12. The system of claim 1 wherein said template base further comprises an adjustable support foot.

13. The system of claim 1 wherein said saddle manifold further comprises guide post receptacles for facilitating installation of said saddle manifold on said template base.

14. The system of claim 1 wherein said saddle manifold further comprises a latch for attaching said saddle manifold to said template base.

15. The system of claim 1 further comprising at least one additional subsea tree assembly.

16. A subsea template/manifold system for phased development of subsea wells at a first site capable of being expanded to develop one or more additional wells at a second site, the system comprising:

at least one flowline extending downwardly from a surface facility to the first well site for directing flow away from the first well site;

at least one subsea wellhead;

a template base having at least one receptacle for receiving said wellhead and means for connecting said wellhead to said template base;

a subsea tree assembly mounted on said wellhead and having a tree-to-manifold connection port;

a saddle manifold mounted on said template base and having at least one production header for directing flow from said tree assembly to said flowline, said manifold also having a valve for isolating the production header from said tree assembly;

said production header having (a) a first end in fluid communication with said flowline, (b) a means for providing fluid communication with said tree-to-manifold connection port, and (c) a second end having a connection point for a flowline extension to the second site;

a first subsea remote control center for controlling operation of said tree assembly having an umbilical termination assembly and at least one control pod;

a main umbilical line connected to said control center; and a jumper umbilical line connecting said control center to said tree assembly.

17. The system of claim 16 further comprising a flowline extension extending from the second end of the production header to the second site.

18. The system of claim 16 wherein said template base further comprises at least one pad and at least one rail for aligning said saddle manifold on said template base.

19. The system of claim 16 wherein said second end connection point comprises an extendable pigging valve assembly.

20. The system of claim 16 wherein said control center comprises pilot hydraulic controls and said main umbilical and said jumper umbilical comprises hydraulic umbilical lines.

21. The system of claim 16 wherein said control center comprises electro-hydraulic controls and said main umbilical and said jumper umbilical comprise electrical umbilical lines.

22. The system of claim 16 wherein said control center further comprises means for extending umbilical lines.

23. The system of claim 22 further comprising:

a second control center located proximal to the second site; and an umbilical extension line connecting said second control center to said extending means of said first control center.

24. The system of claim 23 wherein said extending means of said first control center comprises means for extending electrical umbilical lines, and said umbilical extension line comprises an electrical umbilical extension line.

25. The system of claim 23 wherein said extending means of said first control center comprises means for extending hydraulic umbilical lines, and said umbilical extension line comprises a hydraulic umbilical extension line.

26. The system of claim 16 wherein the connecting means of said template base comprises a latch ring.

27. The system of claim 16 wherein said saddle manifold comprises at less than four production headers.

28. The system of claim 16 wherein said template base comprises at least four well receptacles.

29. The system of claim 16 wherein said saddle manifold comprises at least four production headers.

30. The system of claim 16 wherein said wellhead further comprises a vertical groove for facilitating rotational positioning of said template base.

31. The system of claim 16 wherein said template base further comprises an adjustable support foot.

32. The system of claim 16 wherein said saddle manifold further comprises guide post receptacles for facilitating installation of said saddle manifold on said template base.

33. The system of claim 16 wherein said saddle manifold further comprises a latch for attaching said saddle manifold to said template base.

34. The system of claim 16 further comprising at least one additional subsea tree assembly.

35. The system of claim 16 further comprising at least one additional main umbilical line.

36. The system of claim 16 further comprising at least one additional jumper umbilical line.

37. The system of claim 16 wherein said control center comprises electric controls and said main umbilical and said jumper umbilical comprise electrical umbilical lines.

38. The system of claim 16 wherein said control center comprises a combination of electric and hydraulic controls and said main umbilical and said jumper umbilical comprise a combination of electrical and hydraulic lines.

39. A subsea template/manifold system for phased development of subsea wells at a first site capable of being expanded to develop one or more additional wells at a second site, the system comprising:

at least one flowline extending downwardly from a surface facility to the first well site for directing flow away from the first well site;

at least one subsea wellhead;

a template base having (a) at least one receptacle for receiving said wellhead, (b) at least one alignment pad and at least one alignment rail, and (c) means of connecting said wellhead to said template base;

a subsea tree assembly mounted on said wellhead and having a tree-to-manifold connection port;

a first saddle manifold mounted on said template base and having at least one production header for directing flow from said tree assembly to said flowline, said manifold also having a valve for isolating the production header from said tree assembly;

said production header having (a) a first end in fluid communication with said flowline, (b) a means for providing fluid communication with said tree-to-manifold connection port, and (c) a second end having a connection point for a flowline extension to the second site;

a flowline extension having (a) a first end attached to said second end connecting means of said production header and (b) a second end extending to the second site;

a first subsea remote control center for controlling operation of said tree assembly having (a) an umbilical termination assembly, (b) means for extending umbilical lines, and (c) at least one control pod;

a main umbilical line connected to said control center; and a jumper umbilical line connecting said control center to said tree assembly.

40. The system of claim 39 wherein said second end connecting point comprises an extendable pigging valve assembly.

41. The system in claim 39 further comprising:

a second subsea tree assembly proximal to the second site; and an additional jumper umbilical extending from said control center to said second subsea tree assembly.

42. The system in claim 39 further comprising:

a second template; and a second saddle manifold having at least one production header, wherein said flowline extension connects said production header of said second saddle manifold to said production header of said first saddle manifold.

43. The system of claim 39 further comprising:

a second control center located proximal to the second site; and an umbilical extension line connecting said second control center to said extending means of said first control center.

44. The system of claim 43 wherein said extending means of said first control center comprises means for extending electrical umbilical lines, and said umbilical extension line comprises an electrical umbilical extension line.

45. The system of claim 43 wherein said extending means of said first control center comprises means for extending hydraulic umbilical lines, and said umbilical extension line comprises a hydraulic umbilical extension line.

46. The system of claim 39 wherein said control center comprises electro-hydraulic controls and said main umbilical and said jumper umbilical comprise electrical umbilical lines.

47. The system of claim 39 wherein said control center comprises pilot hydraulic controls and said main umbilical and said jumper umbilical comprises hydraulic umbilical lines.

48. The system of claim 39 wherein said control center comprises electro-hydraulic controls and said main umbilical and said jumper umbilical comprise hydraulic umbilical lines.

49. The system of claim 39 wherein the connecting means of said template base comprises a latch ring.

50. The system of claim 39 wherein said saddle manifold comprises at least four production headers.

51. The system of claim 39 wherein said template base comprises at least four well receptacles.

52. The system of claim 39 wherein said saddle manifold comprises less than four production headers.

53. The system of claim 39 wherein said wellhead further comprises a vertical groove for facilitating rotational positioning of said template base.

54. The system of claim 39 wherein said template base further comprises an adjustable support foot.

55. The system of claim 39 wherein said saddle manifold further comprises guide post receptacles for facilitating installation of said saddle manifold on said template base.

56. The system of claim 39 wherein said saddle manifold further comprises a latch for attaching said saddle manifold to said template base.

57. The system of claim 39 further comprising at least one additional subsea tree assembly.

58. The system of claim 39 further comprising at least one additional main umbiligal line.

59. The system of claim 39 further comprising at least one additional jumper umbilical line.

60. The system of claim 39 wherein said control center comprises electric controls and said main umbilical and said jumper umbilical comprise electrical umbilical lines.

61. The system of claim 39 wherein said control center comprises a combination of electric and hydraulic controls and said main umbilical and said jumper umbilical comprise a combination of electrical and hydraulic lines.

62. The system of claim 39 wherein the second site comprises a cluster type well.

63. The system of claim 16 wherein said template base comprises less than five well receptacles.

64. The system of claim 39 wherein said template base comprises less than five well receptacles.

* * * * *